US005115926A

United States Patent [19]

Kaufhold

[11] Patent Number: 5,115,926

[45] Date of Patent: May 26, 1992

[54] COUPLER MEMBER RETENTION IN A RAILWAY VEHICLE

[75] Inventor: Horst T. Kaufhold, Chicago, Ill.

[73] Assignee: Amsted Industries Incorporated, Chicago, Ill.

[21] Appl. No.: 568,773

[22] Filed: Sep. 26, 1990

[51] Int. Cl.[5] ..... B61G 9/20

[52] U.S. Cl. ..... 213/50; 213/51; 213/61; 213/75 R

[58] Field of Search ..... 213/50, 51, 54, 61, 213/62 R, 75 R

[56] References Cited

U.S. PATENT DOCUMENTS

| | | | |
|---|---|---|---|
| 1,273,908 | 7/1918 | O'Conne | 213/50 X |
| 2,386,476 | 10/1945 | Kinne et al. | 213/50 X |
| 2,645,362 | 7/1953 | Spence | 213/62 R |
| 4,531,648 | 7/1985 | Paton | 213/50 |
| 4,700,853 | 10/1987 | Altherr et al. | 213/50 |

*Primary Examiner*—Robert J. Oberleitner

*Assistant Examiner*—S. Joseph Morano

*Attorney, Agent, or Firm*—Edward J. Brosius

[57] ABSTRACT

An improved arrangement for retention of a drawbar is provided in which a single retention member of unitary construction extends laterally within the center sill and fits completely about a longitudinal portion of the butt end of the drawbar. A vertical connecting pin passes through a vertical opening in the drawbar and is also received in aligned vertical openings in the retention member to connect the drawbar to the retention member. The longitudinal draft loads of the drawbar are distributed over the entire interfacing portions of the vertical connecting pin and the retention member for transfer to striker members which are integrated with the center sill and ultimately dispose the longitudinal draft loads into the center sill. The retention arrangement is easily installed and removed and no welding is required between the retention member and the center sill.

9 Claims, 2 Drawing Sheets

COUPLER MEMBER RETENTION IN A RAILWAY VEHICLE

BACKGROUND OF THE INVENTION

The present invention relates generally to railway coupler connections and more particularly to an improved arrangement for retention of a slackless coupler member in which the longitudinal draft loads of the coupler member are distributed over a larger area allowing for reduced concentration of stress in the center sill and the coupler member connection.

Railway cars are connected together by coupler members, namely drawbars or couplers. Drawbars are integral units known to be used in the railroad industry to extend between and permanently connect two or more railcars. Couplers are independent units in each car which interconnect with one another between adjacent cars, to form a connection. In either instance, a shank and butt end of the drawbar or coupler extends into the center sill of a railway car where it is secured to transmit longitudinal loads to the car.

One type of drawbar is currently positioned and held within the center sill of a railway car by the combination of a draft key inserted through a pair of sill side castings. Such an arrangement is shown in Altherr et al, U.S. Pat. No. 4,700,853 wherein the sill side castings have inward projections to center the drawbar within the center sill. In addition to laterally positioning and holding the drawbar, the sill side castings have also fully encircled the draft key so as to transfer the longitudinal loads, particularly the draft load, of the drawbar from the draft key to the center sill.

One problem with this arrangement is that the surface area for draft load distribution between the horizontal draft key and the sill side castings is limited to the small arcuate edge portions of the draft key which are in contact with the sill side castings. This results in a high concentration of stress which can lead to fatigue and failure. It has therefore been necessary that the sill side castings be rigidly secured (heavily welded) to the inside of the center sill so as to withstand the longitudinal draft loads of the drawbar.

It is advantageous in operating a railroad to have railway cars which can be converted from a drawbar arrangement to a coupler arrangement. Accordingly, it is desirable to have a drawbar retention arrangement that is removable. However, the only way to remove the sill side castings is to burn off the heavy welding on the inside of the center sill. Burning off this heavy weld is extremely difficult and often causes damage to a portion of the center sill side wall which must be restored or replaced. This procedure is costly and time consuming.

SUMMARY OF THE INVENTION

Accordingly, it is an object of the present invention to provide an improved drawbar retention arrangement which will distribute the longitudinal draft loads from the drawbar to the center sill over a larger surface area to reduce the concentration of stress.

It is another object of the present invention to provide an improved drawbar retention arrangement which is easy to install and to remove, without modifications to the center sill side walls.

By the present invention, it is proposed to overcome the difficulties encountered heretofore. To this end, it has been discovered that an increased surface area for distribution of the longitudinal draft loads from the drawbar can be achieved by providing a single retention member of unitary construction which extends laterally within the center sill and fits completely about a longitudinal portion of the butt end of the drawbar. A vertical connecting pin passes through a vertical opening in the drawbar and is also received in aligned vertical openings in the retention member to connect the drawbar to the retention member and transfer the longitudinal draft loads. The longitudinal draft loads from the drawbar are thus distributed over the larger surface area of the interface between the top and bottom portion of the vertical connecting pin and the retention member. The retention member, in turn, abuts against reinforced striker members which are added to the inner side walls of the center sill for further disposition of the longitudinal draft loads. The retention member of the present invention may be bolted to the center sill side walls and is therefore easily installed and removed without the heavy welding used heretofore. Furthermore, no modification is required of the center sill during conversion of the drawbar arrangement to a coupler arrangement and vice versa.

DETAILED DESCRIPTION OF THE INVENTION

Figure 1:
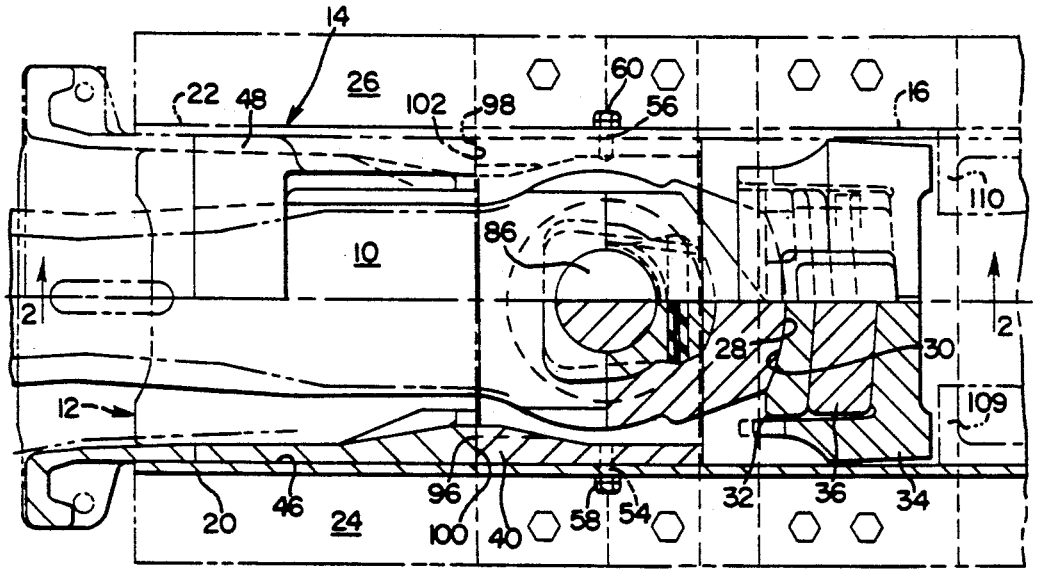
FIG. 1 is a section plan view of a preferred embodiment of the invention.
Figure 2:
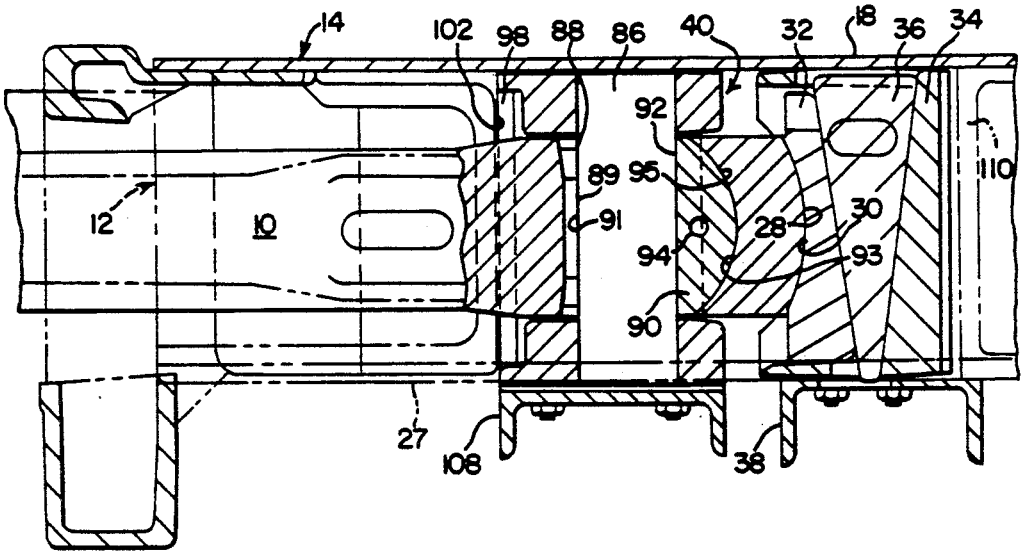
FIG. 2 is a side elevation of the apparatus, partially in section taken along lines 2—2 of FIG. 1 with certain parts broken away for clarity.
Figure 3:
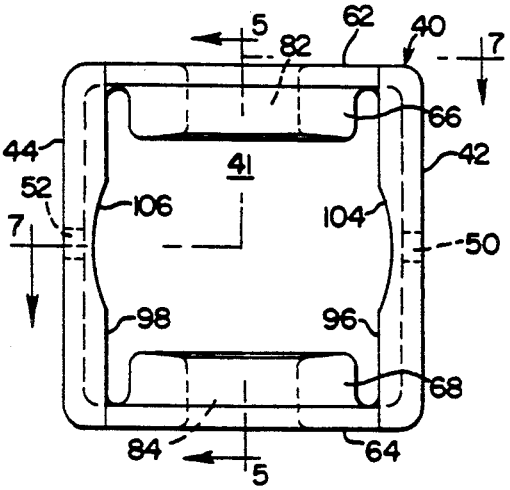
FIG. 3 is a front elevation of the retention member of the present invention.
Figure 4:
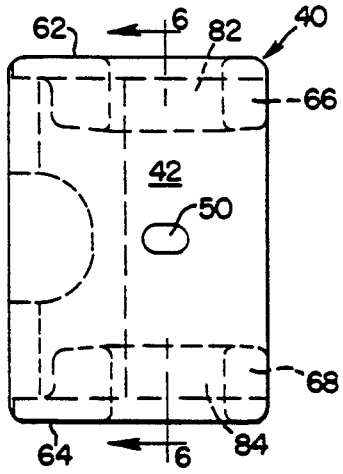
FIG. 4 is a side elevation of the retention member shown in FIG. 3.
Figure 5:
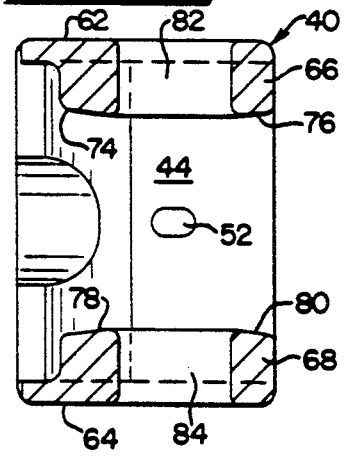
FIG. 5 is a sectional elevation of the retention member taken along lines 5—5 of FIG. 3.
Figure 6:
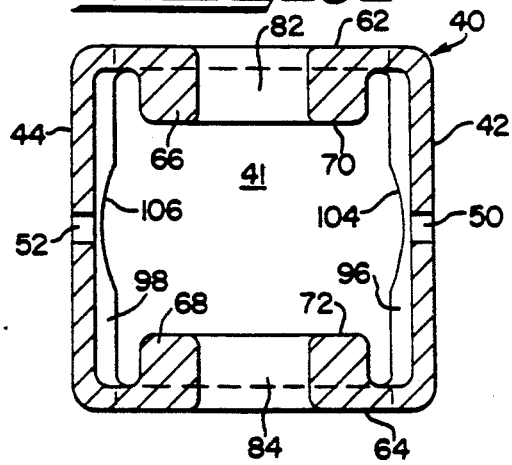
FIG. 6 is a sectional elevation of the retention member taken along lines 6—6 of FIG. 4.
Figure 7:
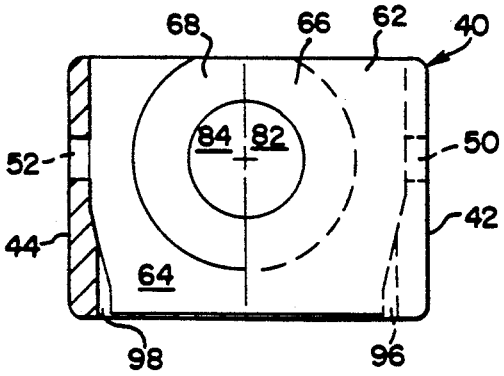
FIG. 7 is a section plan view of the retention member taken along lines 7—7 of FIG. 3.

In FIGS. 1 and 2, one end of a slackless coupler member such as a drawbar embodying the improved design of the present invention is shown generally at 10. The drawbar 10 extends within an open end 12 of a center sill, generally 14, which is secured longitudinally beneath a railway car (not shown). The center sill 14 is of a standard construction comprising an inverted U-shaped channel member 16 having top wall 18, side walls 20 and 22 and outturned flanges 24 and 26 at the lower open bottom 27.

A spherical butt end 28 of drawbar 10 fits against a matching spherical face 30 of a follower block 32 which is held within a pocket casting 34. A vertically tapered wedge 36 is located between the follower block 32 and the pocket casting 34 to remove slack. The pocket casting 34 is mounted cross-wise within the center sill 14 upon a support channel 38 which is fastened to the sill flanges 24 and 26.

According to the present invention, the drawbar 10 is centered vertically, laterally and longitudinally within the center sill 14 by a single drawbar retention member 40 which extends laterally within the center sill 14 and fits completely about a longitudinal portion of the butt end 28 of the drawbar 10 The butt end 28 of the drawbar 10 accordingly passes through a passageway 41 contained in the retention member 40.

The retention member 40 is of unitary construction and comprises a pair of side walls 42 and 44 which, when assembled, are located on both sides of the drawbar 10 and the inside surfaces 46 and 48 of the center sill side walls 20 and 22 respectively. The retention member side walls 42 and 44 have openings 50 and 52 respectively in alignment with openings 54 and 56 in the respective center sill side walls 20 and 22 for receiving attachment bolts 58 and 60 and thereby securing the retention member 40 to the center sill 14.

The retention member 40 further comprises a top wall 62 which abuts the top wall 18 of the center sill 14 and a bottom wall 64 which is located at the open bottom 27 of the center sill 14. The top and bottom walls 62 and 64 of the retention member 40 each include raised upper and lower bosses 66 and 68 respectively which project equally into the cavity 41 of the retention member 40 towards the drawbar 10. The upper and lower bosses 66 and 68 each contain substantially planar, substantially horizontal drawbar contact surfaces 70 and 72 respectively. Drawbar contact surface 70 includes a sloped front edge 74 and a sloped rear edge 76 while drawbar contact surface 72 has a sloped front edge 78 and a sloped rear edge 80. Edges 74, 76, 78 and 80 are sloped on individual planes at acute angles from the plane which passes along the horizontal portions of the contact surfaces 70 and 72 to provide clearance for the slight vertical angling of the drawbar 10 within the center sill 14 which occurs during service.

The top wall 62 and upper boss 66 have a vertical opening 82 which is aligned with a vertical opening 84 in the bottom wall 64 and lower boss 68 of the retention member 40. The openings 82 and 84 are shaped to receive a vertical connecting pin 86 to connect the drawbar 10 to the retention member 40. The vertical connecting pin 86 passes through the openings 82 and 84 as well as through an opening 88 in the drawbar 10. The opening 88 in the drawbar 10 has a first concave vertical side 89 adapted to receive the front edge 91 of the vertical connecting pin 86 and a second side 93 which is spherically contoured to correspond in shape to the spherical butt end 28 of the drawbar 10. The drawbar opening 88 retains therein a correspondingly shaped pin bearing block 90 which has a first concave vertical side 92 adapted to receive the rear edge 94 of the vertical connecting pin 86 and a second side 95 which is correspondingly shaped to be received in the spherically contoured second side 93 of the drawbar opening 88. The aforementioned arrangement of vertical connecting pin 86, pin bearing block 90, retention member 40 and follower block 32, permits vertical and horizontal angling of the drawbar 12 within the center sill 14.

The retention member side walls 42 and 44 gradually increase in thickness, each having its greatest cross-sectional area at vertical ribs 96 and 98. The vertical ribs 6 and 98 interface at the inner surfaces 46 and 48 of the center sill side walls 20 and 22 with center sill striker members 100 and 102 respectively. The striker members 100 and 102 may be cast integral with or rigidly secured to the center sill 14. The striker members 100 and 102 are located proximate to the inner surfaces 46 and 48 of the center sill side walls 20 and 22 respectively and extend longitudinally to the position which is proximate to the vertical ribs 96 and 98 of the retention member side walls 42 and 44. The striker members 100 and 102 also gradually increase in thickness, each having its greatest cross-sectional area at its interface with the vertical ribs 96 and 98 of the retention member 40.

In order to pass the spherical butt end 28 of the drawbar 10 through the passageway 41 of the retention member 40, the vertical ribs 96 and 98 of the retention member side walls 42 and 44 have arcuate cut-outs 104 and 106 which will allow passage of the largest diameter of the drawbar 10 therethrough while still providing the maximum possible cross-sectional area for load transfer to the striker members 100 and 102.

The vertical connecting pin 86 and retention member 40 are held in place at the open bottom 27 of the center sill 14 by a support channel 108 which is bolted to the outturned flanges 20 and 26 of the center sill 14.

During service, the longitudinal draft loads from the drawbar 10 are transmitted by the vertical connecting pin 86 to the retention member 40. The retention member 40, in turn, transmits the longitudinal draft loads to the striker members 100 and 102 at the interface between the vertical ribs 96 and 98 of the retention member 40 and the striker members 100 and 102. The increased section area in both the retention member ribs 96 and 98 as well as the striker members 100 and 102 at these interfaces provides adequate reinforcement to carry the draft loads. The buff loads from the drawbar 10 are transmitted directly to the follower block 32, tapered wedge 36 and pocket casting 34 into center sill rear stops 109 and 110. No buff loads are taken by the vertical connecting pin 86 or the retention member 40.

When the longitudinal draft loads are transferred from the vertical connecting pin 86 to the retention member 40, a much larger surface area is utilized than in the horizontal draft key and sill side castings of the prior art. The area of contact in the prior art extended along the linear arcuate front edge of the horizontal draft key. In the present invention the area of contact is increased greatly due to the longer vertical dimension resulting from the raised upper and lower bosses 66 and 68 as well as the longer horizontal dimension resulting from the diameter of the vertical connecting pin 86. The greater surface area results in reduced stress concentration in the center sill 14 and the coupler member connection, in general.

The arrangement of the present invention can thus adequately handle the load transfer between the drawbar 10 and the center sill 14 without the necessity of rigidly attaching (heavily welding) the retention member 40 to the center sill 14 as in the prior art.

The elimination of welding due to the reduced concentration of stress also results in an arrangement that is easy to install and remove for railway car conversion. The method of construction comprises: placing the retention member 40 within the center sill 14 and securing the retention member 40 to the center sill 14 with bolts 58 and 60; passing the butt end 28 of the drawbar 10 through the retention member 40 and into contact with the follower block 32; inserting the vertical connecting pin 86 through the retention member openings 82 and 84 as well as drawbar opening 88 in which pin bearing block 90 is already in place; and attaching support channel 108 across the open bottom 27 of the center sill 14 to hold the retention member 40 and the vertical connecting pin within the center sill. To remove the arrangement, the reverse is performed.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. An improved center sill construction for a railway car of the type having a coupler member extending into a railway car center sill with striker members, said coupler member having a butt end for connection within said center sill, said center sill having a longitudinal axis, a first sidewall with a flange, a second sidewall with a second flange, and an upper wall cooperating to define a center sill channel with an open end, the improvement comprising:

a single retention member of unitary construction extending laterally within said center sill and fitting completely about a longitudinal portion of said butt end of said coupler member, said retention member having a first sidewall, a second sidewall, an upper wall and a lower wall, cooperating to define a cavity, which retention member sidewalls and upper and lower walls having a front edge and a rear edge, each of said retention member upper and lower walls having a boss projecting into said cavity and an opening through each said boss and retention member upper and lower walls, which retention member upper and lower wall openings are aligned;

each of said retention member sidewalls having a first wall cross-sectional area at said front edge and a second wall cross-sectional area displaced from said front edge along said longitudinal axis such that said first wall cross-sectional area is greater than said second wall cross-sectional area, said first wall and said second wall of said center sill channel having striker members attached to each of said walls such that each of said striker members contact said retention member sidewalls at said front edges to transfer draft loads from said retention member to said center sill.

2. The invention according to claim 1 in which said bosses further include substantially planar, substantially horizontal contact surfaces for abutting top and bottom surfaces of said butt end of said coupler member, said contact surfaces being sloped along their front and rear edges, said edges being sloped on individual planes at acute angles from a plane which passes along said substantially horizontal contact surfaces.

3. The invention according to claim 1 in which said top and bottom walls of said retention member, said upper and lower bosses and said butt end of said coupler member all contain openings forming a passageway in which a vertical connecting pin is received to connect said coupler member to said retention member.

4. The invention according to claim 3 in which a support channel is attached across an open bottom of said center sill to secure said vertical connecting pin and said retention member within said center sill.

5. The invention according to claim 1 in which said striker members are located proximate to the inside of respective side walls of said center sill, said striker members gradually increase in thickness having their greatest cross-sectional area adjacent said front edge of said retention member.

6. The invention according to claim 1 in which said front edges of said retention member side walls include opposed arcuate cut-outs allowing said front edges of said side walls to accommodate said butt end of said coupler member.

7. An improved drawbar retention member for use with a drawbar connection of a railway car, said drawbar retention member for laterally and vertically positioning a drawbar member evenly within the cavity of a center sill with striker members, said center sill having a longitudinal axis, a first sidewall with a flange, a second sidewall with a second flange, and an upper wall cooperating to define a center sill channel with an open end, the improvement comprising:

a top wall with an inner surface, said inner surface having a raised upper boss surrounding a vertical opening, said boss projecting towards said cavity, a bottom wall with an inner surface, said inner surface having a raised lower boss surrounding a vertical opening on said inner surface, said raised lower boss projecting towards said raised upper boss, a pair of retention member side walls, said retention member side walls cooperating with said retention member top and bottom walls to define a front edge and a rear edge, each of said retention member side walls gradually increasing in thickness from said rear edge towards said front edge having their greatest cross-sectional area at said front edge of the retention member, said front edges contacting said striker members on said center sill to transfer draft loads from said retention member into said center sill.

8. The invention according to claim 7 in which said upper and lower bosses comprise substantially planar, substantially horizontal surfaces about said vertical openings, said surfaces having sloped edges at longitudinally opposite ends of said surfaces, said edges being sloped on individual planes at acute angles from a plane which passes along said substantially horizontal surfaces.

9. The invention according to claim 7 in which retention member side walls comprise arcuate recesses in said front edge of said retention member, said arcuate recesses located opposite to one another forming an elongated opening in said front edge of said retention member.

* * * * *